United States Patent [19]

Hintsch

[11] 4,361,017

[45] Nov. 30, 1982

[54] PATTERN MECHANISM

[75] Inventor: Otto Hintsch, Wallisellen, Switzerland

[73] Assignee: Karl Mayer Textil-Maschinen-Fabrik, Frankfurt, Fed. Rep. of Germany

[21] Appl. No.: 157,056

[22] Filed: Jun. 6, 1980

[30] Foreign Application Priority Data

Jun. 12, 1979 [CH] Switzerland ..... 5473/79

[51] Int. Cl.[3] ..... D04B 23/00

[52] U.S. Cl. ..... 66/207

[58] Field of Search ..... 66/207, 204, 231

[56] References Cited

U.S. PATENT DOCUMENTS 4,139,997 2/1979 Riesen ..... 66/207

*Primary Examiner*—Ronald Feldbaum

*Attorney, Agent, or Firm*—Kenyon & Kenyon

[57] ABSTRACT

The pattern mechanism uses final control elements which are controlled in accordance with a pattern for producing a controlled shogging motion of the guide bars or strips. Additional program-controlled control elements are added to avoid a loss in the shogging stroke. These latter elements are optionally controlled via a program carrier and prevent the pattern yarns controlled by the guide bars from being positioned into a faulty sinker lane irrespective of the length of the shogging stroke. The stroke of one correcting element can be, for example one quarter of the unit stroke of the main control elements while the stroke of the other added element can be one half of the stroke unit.

7 Claims, 2 Drawing Figures

PATTERN MECHANISM

Figure 1:
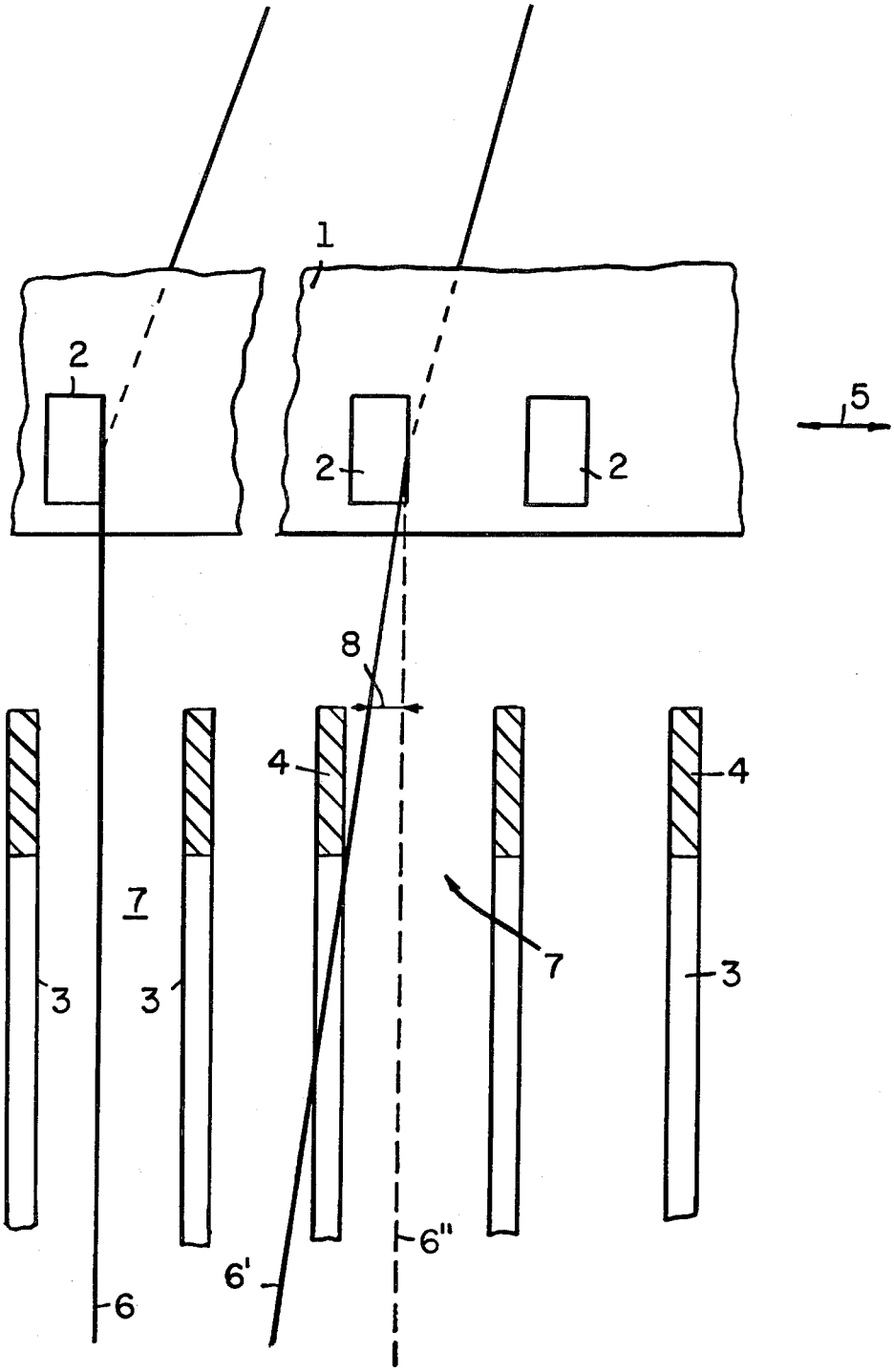

This invention relates to a pattern mechanism. More particularly, this invention relates to a pattern mechanism for a warp knitting machine.

As is known, warp knitting machines have been provided with pattern mechanisms whereby a multiplicity of guide bars or guide strips can be reciprocated in a shogging direction by means of elongated flexible tension elements which, in turn, are controlled in the shogging direction by final control elements in accordance with a pattern. Mechanisms of this kind are called "additive gearing", for example as described in East German Patent Specification No. 124,662. The strokes of the final control elements of these known systems are dimensioned so that, for example, the stroke of a first final control element produces a shogging motion equal to a needle or sinker spacing while the stroke of additional final control elements produces a shogging motion equal to a multiple of the needle or sinker spacing.

Generally, in warp knitting machines which employ these known pattern mechanisms, guide bars are usually adjusted so that in the absence of shogging, the pattern yarns are in the middle of the needle lane whereas, in machines having guide strips fixed in the swinging direction, for example as described in German Pat. No. 15 85 536, the pattern yarns are exactly in the middle between two sinker heads of a lying-in comb. Consequently, if shogging occurs to the left or to the right, the yarn moves in the penetration region of the front edges of the sinker heads and, due to the resulting oblique position, moves relatively away from the middle of the needle lane or pair of sinkers in question since the lower end of the yarns are fixed in their position at the level of the needle heads. The movement increases with increasing shogging and with increasing distance between the needle head and the bottom edge of the needle guide or between the sinker head and the bottom edge of the guide strip. Since the yarn moves relatively away in the opposite direction from the shogging direction, the result is a relative loss in the shogging stroke. If the loss exceeds a certain value, the yarns cannot reach the required sinker lane or needle lane. Hence, the maximum shogging stroke of the knitting machine is limited by the amount of the loss.

Accordingly, it is an object of the invention to eliminate any relative loss in shogging stroke in a warp knitting machine.

It is another object of the invention to provide a pattern mechanism for a warp knitting machine which can be easily controlled.

It is another object of the invention to provide a pattern mechanism for a warp knitting machine which is able to avoid a pattern yarn not reaching the required sinker or needle lane.

Briefly, the invention provides a pattern mechanism for a guide bar of a warp knitting machine which is comprised of an elongated flexible tension element secured to the guide bar, a plurality of main control elements for selectively varying the effective length of the tension element relative to the guide bar, each of which has a stroke equal to a multiple of a given value for producing a shogging motion on the guide bar, and at least one supplemental program-controlled control element for selectively varying the effective length of the tension element which has a stroke equal to a fraction of the given value.

The pattern mechanism is used in combination with a plurality of sinkers which are disposed in equi-spaced relation at a given sinker spacing.

It is sufficient for example, to provide two supplemental program-controlled control elements, one of which has a stroke for producing a shogging motion equal to one quarter of the sinker spacing while the other has a stroke for producing a shogging motion equal to three quarters of the sinker spacing.

In order to actuate the main control elements and the supplemental control elements, a suitable program carrier is used, but also, a separate supplemental program carrier can be provided for actuating at least one of the supplemental control elements.

Before the knitting machine is placed in operation, the supplemental program-controlled control elements are provided for in the appropriate program carrier. To this end, depending on the length of shogging required and the amount of shogging loss, both of which can easily be determined, the machine operator adjusts the machine in accordance with the pattern which is to be worked. The shogging stroke can thus be considerably increased without the risks of faults in knitting.

These and other objects and advantages of the invention will become more apparent from the following detailed description and appended claims taken in conjunction with the accompanying drawings.

Figure 2:
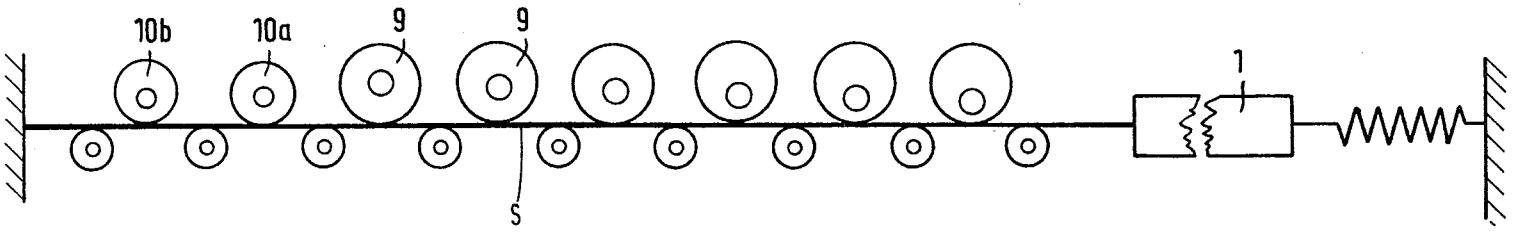

FIG. 1 diagramatically illustrates a spatial relation between a guide bar and a plurality of sinkers of a warp knitting machine relative to a pattern yarn; and FIG. 2 illustrates a pattern mechanism constructed in accordance with the invention.

Referring to FIG. 1, the warp knitting machine is provided with a guide bar, for example a guide strip 1 having a plurality of yarn guides 2 therein and a plurality of sinkers 3 of a laying-in comb below the guide strip 1. The sinkers 3 are disposed in equi-spaced relation on a given sinker or needle spacing and have heads 4 which are disposed perpendicularly to the plane of the drawing.

The guide strip 1 is connected with a pattern mechanism which is able to reciprocate the strip 1 in a shogging direction as indicated by the arrow 5. If no shogging occurs, the guide strip 1 and the sinkers 3 are arranged so that a pattern yarn 6 passes downwardly from the yarn guides 2 centrally through a sinker lane 7 formed by each pair of adjacent sinkers 3. However, should the strip 1 move during shogging, each pattern yarn 6 is moved into an inclined position 6' to an extent depending substantially on the shogging length and relatively in a direction towards an adjacent sinker head 4 opposite to the direction of shogging. The resulting relative displacement 8 from the central path 6'' shown in broken lines of yarn 6 to the inclined path of a yarn 6' is regarded as a loss in the shogging stroke. If this loss becomes greater than that shown, the yarn 6' may strike the sinker head and a fault may occur during knitting. However, this disadvantage is obviated by the pattern mechanism.

Referring to FIG. 2, the pattern mechanism includes an elongated flexible tension element S which is secured to the guide strip 1 at one end and to a fixed point at an opposite end. In addition, a plurality of control elements 9 are provided for selectively varying the effective length of the tension element S relative to the guide strip 1. Each of these control elements 9 is constructed, for example as described in U.S. Pat. No. 4,139,997 so as to have a stroke for producing a shogging motion equal to a multiple of a given value, i.e. the sinker spacing. This multiple may be equal, for example to 1, 2, 3...n. These control elements 9 can be actuated via a program carrier (not shown) in known fashion. In addition, the pattern mechanism has a pair of supplemental program-controlled control elements 10*a*, 10*b* for selectively varying the effective length of the tension element relative to the guide strip 1. These control elements 10*a*, 10*b* have a stroke for producing a shogging motion on the guide strip 1 which is equal to a fraction of the sinker spacing. For example, one control element 10*a* has a stroke equal to one quarter of the unit stroke of the control elements 9 whereas element 10*b* has a stroke equal to one half the unit stroke. These additional control elements 10*a*, 10*b* can be operated individually or cumulatively depending upon the pattern and the value of the expected loss of stroke, by a supplemental program carrier (not shown) which can be incorporated into the program carrier of the elements 9. If the elements 10*a*, 10*b* are switched together, the result is an additional stroke of three quarters of a stroke unit. In this manner, the pattern yarns 6 can be so controlled for any length of stroke as to always engage in the correct needle lane or sinker lane 7 when the yarn is positioned in an inclined fashion.

The invention thus provides a pattern mechanism for avoiding a faulty positioning of the pattern yarns relative to the sinkers of a warp knitting machine. Further, the invention provides a pattern mechanism which is able to adjust the position of a guide bar or strip to a particular shogging pattern.

The added supplemental program-controlled control elements 10*a*, 10*b* can be constructed in similar fashion to the elements 9. For example, each control element 10*a*, 10*b* can be formed as an eccentrically mounted disc.

What is claimed is:

1. In combination with a guide bar of a warp knitting machine, a pattern mechanism comprising an elongated flexible tension element secured to said guide bar at one end to a fixed point at an opposite end;

a plurality of main control elements for selectively varying the effective length of said tension element relative to said guide bar, each said control element having a stroke for producing a shogging motion on said guide bar equal to a multiple of a given value; and at least one supplemental program-controlled control element for selectively varying the effective length of said tension element relative to said guide bar, said program-controlled control element having a stroke for producing a shogging motion on said guide bar equal to a fraction of said given value.

2. The combination as set forth in claim 1 wherein said multiple is equal to 1.

3. In combination with a plurality of sinkers of a warp knitting machine disposed in equi-spaced relation at a given sinker spacing and a guide bar disposed over said sinkers; a pattern mechanism comprising an elongated flexible tension element secured to said guide bar at one end and to a fixed point at an opposite end;

a plurality of main control elements for selectively varying the effective length of said tension element relative to said guide bar, each said control element having a stroke for producing a shogging motion on said guide bar equal to a multiple of said sinker spacing; and at least one supplemental program-controlled control element for selectively varying the effective length of said tension element relative to said guide bar, said supplemental control element having a stroke for producing a shogging motion equal to a fraction of said sinker spacing.

4. The combination as set forth in claim 3 which further comprises a pair of said program-controlled control elements, one of which has a stroke equal to $\frac{1}{4}$ of said sinker spacing and the other of which has a stroke equal to $\frac{1}{2}$ of said sinker spacing.

5. The combination as set forth in claim 4 which further comprises a program carrier for actuating said main control elements and a supplemental program carrier for actuating at least one of said supplemental control elements.

6. The combination as set forth in claim 3 wherein said guide bar has a plurality of yarn guides therein for passage of pattern yarns therethrough, each said opening being aligned with a respective pair of sinkers to dispose a pattern yarn centrally of said pair of sinkers.

7. The combination as set forth in claim 3 wherein each program-controlled control element is an eccentrically mounted disc.

* * * * *